US007771110B2

(12) United States Patent
Wang

(10) Patent No.: US 7,771,110 B2
(45) Date of Patent: Aug. 10, 2010

(54) TWISTED STATIC PASTE MIXER WITH A DYNAMIC PREMIXING CHAMBER

(75) Inventor: Daniel Wang, Walnut, CA (US)

(73) Assignee: Pac-dent International Inc., Walnut, CA (US)

( * ) Notice: Subject to any disclaimer, the term of this patent is extended or adjusted under 35 U.S.C. 154(b) by 585 days.

(21) Appl. No.: 11/852,296

(22) Filed: Sep. 8, 2007

(65) Prior Publication Data

US 2009/0067284 A1 Mar. 12, 2009

(51) Int. Cl.
*B01F 7/20* (2006.01)

(52) U.S. Cl. ..... 366/155.1; 366/172.1; 366/181.5; 366/325.4; 366/339

(58) Field of Classification Search ..... 366/155.1, 366/155.2, 171.1–172.2, 181.4, 181.5, 325.4, 366/339; 222/145.6, 459
See application file for complete search history.

(56) References Cited

U.S. PATENT DOCUMENTS 3,711,067 A * 1/1973 Kovacs ..... 366/81
4,408,890 A * 10/1983 Beckmann ..... 366/155.2
4,538,920 A * 9/1985 Drake ..... 366/181.5
4,771,919 A * 9/1988 Ernst ..... 222/134
5,487,606 A * 1/1996 Keller ..... 366/339
5,918,772 A * 7/1999 Keller et al. ..... 222/145.6
6,540,395 B2 * 4/2003 Muhlbauer et al. ..... 366/307
6,837,612 B2 * 1/2005 Bublewitz et al. ..... 366/172.1
6,932,243 B2 * 8/2005 Keller ..... 222/145.6
7,731,413 B2 * 6/2010 Busin et al. ..... 366/171.1
2002/0145007 A1 * 10/2002 Sawhney et al. ..... 222/137
2002/0175186 A1 * 11/2002 Keller ..... 222/145.6
2004/0196734 A1 * 10/2004 Mehta et al. ..... 366/138
2004/0213082 A1 * 10/2004 Tobler ..... 366/325.4
2004/0257909 A1 * 12/2004 Pieroni ..... 366/172.1

* cited by examiner

*Primary Examiner*—David L Sorkin

(57) ABSTRACT

A device for mixing two paste components, such as a dental impression substance and a catalyst, comprising a tubular housing, two inlet openings for the two paste components to be mixed, and an outlet opening for delivering the mixed paste, is presented. The housing consists of a premixing chamber at the front end and a tubular mixing chamber at the rear end. The two paste components are mixed first in the premixing chamber by a dynamic rotor and then mixed in the tubular mixing chamber by a twisted static shaft, resulting in a well mixed, bubble-free paste at the outlet opening of the housing.

10 Claims, 1 Drawing Sheet

TWISTED STATIC PASTE MIXER WITH A DYNAMIC PREMIXING CHAMBER

FIELD OF THE INVENTION

The present invention is a disposable device for mixing two paste components, such as a dental impression compound and a catalyst compound. Two inlet openings for the two paste components are located at one end of the device housing, and an outlet opening for the resulting mixed paste is located at the other end of the housing. A conventional static mixing element with serially-arranged, alternately-twisted blades within the tubular portion of the housing mixes the paste components. However, before reaching this tubular mixing chamber, the two paste components enter a dynamic premixing chamber to be premixed.

BACKGROUND OF THE INVENTION

Conventional static mixers and more recent dynamic mixers for mixing highly viscous pastes containing two components, such as dental impression compounds, are found respectively in U.S. Pat. Nos. 3,635,444, 4,014,463, 4,183,682, 4,771,919, 5,033,650, 5,080,262, etc., and 5,249,862, 5,286,105, 6,244,740, 6,532,992, 6,540,395, etc. The device, whether of the static or dynamic type, commonly comprises a cylindrical chamber enclosing a static or rotary mixer element, two inlets adapted for connection to the two components to be mixed, and a discharge opening for the mixed paste outlet. Usually, in order to match the structure positioning of the outlets of the paste component source device (such as a component dispenser), the two inlets of the mixer are located on opposite sides of the mixer shaft, separated by some distance. This separation has the effect that the two components do not reach the tubular mixing chamber simultaneously, if they travel directly, thus making it difficult to obtain a uniformly mixed result at the beginning of the discharge.

This problem has been solved in this invention by adding a dynamic premixing chamber containing a rotating shaft, attached to which are several radially directed wings. On each wing are several posts extruded towards to the inlet, outlet, or both sides of the housing, parallel to the axis of the rotating shaft. The structure of this premixing chamber, which is located between the tubular mixing chamber and the inlets are so arranged that the catalyst component will arrive to the mixing area essentially simultaneously with the impression base component. Hence the paste components from the inlet end are effectively combined in the premixing chamber before flowing into the tubular mixing chamber, already having close to the desired proportions as they first enter. The further mixing in the tubular mixing chamber produces a discharge which is uniform and of the desired proportions from the very beginning.

SUMMARY OF THE PRESENT INVENTION

The invention is a device for mixing two paste components having two inlet openings and one outlet opening for the resulting mixed paste. A premixing chamber containing a dynamically rotating shaft with wings and posts as well as a tubular mixing chamber containing a conventional static mixing shaft with serially-arranged, alternately-twisted blades are both situated between the inlets and the outlet.

The dynamic premixing chamber provides a mechanism that assures the two components to be mixed enter into the tubular static mixing chamber simultaneously and in a thoroughly premixed state. This premixing chamber consists of a shaft, which can be driven rotationally by a component-providing device, such as a dynamic mixing dispenser, several wings perpendicular to the shaft, and several posts on each wing extruded axially towards to the inlet or outlet or both sides of the housing. The arrangement of the inlet openings and the wing-posts at the inlet side matches the actual structure of the dynamic mixing machine to be connected. The paste components are stirred by the wings and the extruded posts in the premixing chamber before flowing into the tubular mixing chamber. In the conventional single-chamber designs, the differing amounts and viscosities of the paste components and the different inlet opening sizes result in the tubular mixing chamber being partly filled with one component before the other component arrives. This causes a waste of the first length of the mixed paste until the desired mixing ratio is achieved. In comparison, this invention produces a mixed paste with a much better mixing ratio from the very beginning by supplying a premixed paste of the desired mixing ratio to the tubular mixing chamber, whose sole function now is to increase the uniformity of the paste.

Indeed, improved uniformity of mixing is another object of the invention. While the dynamic premixing chamber plays an important role in achieving this object, the static mixer after it provides the most important contribution. The static mixing shaft is composed, in an unusual way, of an axial series of twisted blades with alternating senses of rotation in the discharge direction, the trailing edge of each downstream blade being perpendicular to the leading edge of the following upstream blade. In other words, each blade is twisted in a direction opposite to its neighbors. Hence the paste components pass the blades in such a way that the blades alternately push the components in opposite rotational directions, resulting in a better blending effect than unidirectional blades can achieve.

A benefit of this invention is a reduction in the volume of the tubular mixing chamber for the same paste uniformity. Comparing with conventional mixers, since only a single premixed paste enters as opposed to two individual paste components, the volume of the tubular chamber in this invention can be reduced to 50% or less to retain the same mixing effect. Hence the expensive impression materials remaining inside the housing after each usage are reduced even counting the volume of the premixing chamber, so that the cost of each usage of a mixer is reduced.

A further benefit of this invention is the reduction of air-bubbles trapped inside the mixed paste as compared to dynamic mixers because the specially shaped static mixing blades expel any trapped air much more effectively than dynamic blending shafts with unidirectional mixing vanes can. In fact, dynamic mixers tend to mix air into the paste.

Other objects and features of the invention will be in part apparent and in part pointed out hereinafter.

BRIEF DESCRIPTION OF THE DRAWINGS

The features and advantages of the invention will be readily apparent from the following detailed description. The detailed description will be better understood in relation to the accompanying drawings as.

10—assembly, 20—housing, 30—inlet adapt cover, 40—dynamic rotor, 41—hexagonal bore, 31—base component inlet opening, 32—catalyst component inlet opening

40—dynamic rotor, 50—static shaft, 21—end outlet, 60—premixing chamber, 70—tubular mixing chamber

41—hexagonal bore, 42—wings, 43—downstream wing-posts, 44—upstream wing-posts

51—first twisted blade pair, 52—second twisted blade pair

Figure 5:
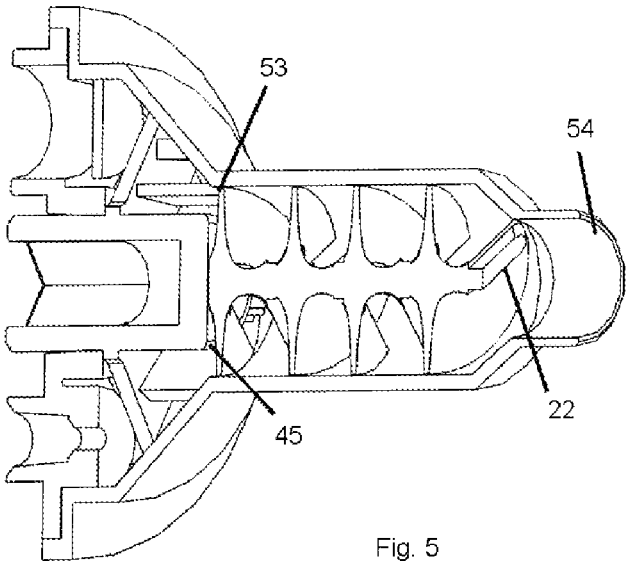

FIG. 5 shows the connection between dynamic/static elements and from static element to housing, where:

53—upstream end of static shaft, 54—downstream end of static shaft, 45—dome-part of dynamic rotor, 22—stopping splinters on housing wall

DETAILED DESCRIPTION OF THE INVENTION

Refer to FIGS. 1-5 for perspective views of the preferred embodiment of the invention including its structure and internal parts. It will be seen that the several objects of the invention are achieved.

Although specific examples of the present invention and its application are set forth herein, it is not intended that they are exhaustive or limiting of the invention. These illustrations and explanations are intended to acquaint others, skilled in the fabrication of such devices, with this particular invention, its principles, and its practical application, so that they may adapt and apply the invention, in its numerous forms, as may be best suited to the requirements of a particular use.

Figure 1:
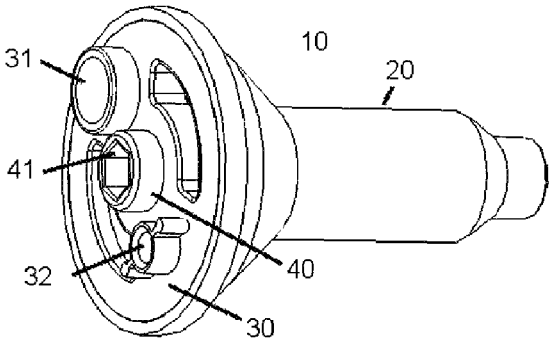
FIG. 1 is a general perspective view of the assembled mixer, where.

Refer first to FIG. 1 for perspective view of a mixer 10, which serves as a preferred embodiment of the present invention. The mixer includes a tubular housing 20, an inlet adapter cover 30 and a dynamic rotor 40 in contact with a static shaft 50 (not shown) inside the housing. The base component opening 31 and the catalyst component opening 32 in the inlet adapter cover 30 match the outlet structure of the dispenser (not shown). The hexagonal bore 41 on the dynamic rotor 40 matches the hexagonal shaft of the dispenser (not shown) to accept the dynamic driving torque.

Figure 2:
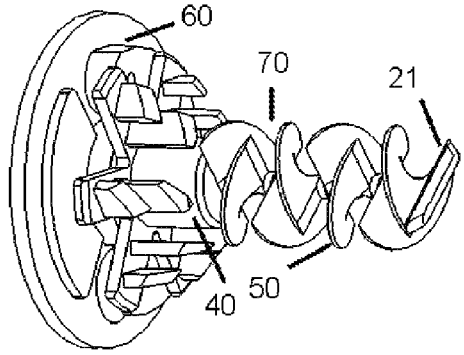
FIG. 2 is a transparent view of the mixer, showing the structure inside, where.

FIG. 2 is the corresponding perspective view which shows the assembled structures inside the housing 20 (shown as transparent). The upstream end of the dynamic rotor 40, within the premixing chamber 60, is firmly connected to the hexagonal shaft of the dispenser while the dome-shaped downstream end of the rotor is freely connected to the upstream end of the static shaft 50. When the mixer is connected to the dispenser, the base and catalyst components from the dispenser will be pressed into the openings 31 and 32 respectively. The dynamic rotor 40 is rotated by the driving torque from the dispenser rotating shaft and mixes the components in the premixing chamber 60 first, then the mixed components flow into the tubular mix chamber 70 to be further mixed by the static shaft 50. Finally the well-mixed paste is extruded through the end outlet 21 of the housing 20.

Figure 3:
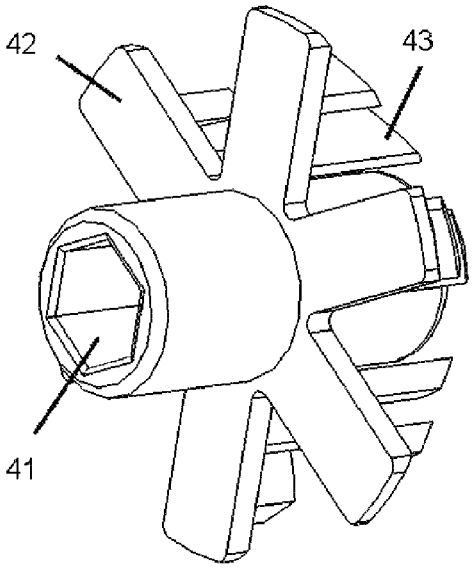
FIG. 3 is a perspective view of the dynamic element, where.

FIG. 3 shows details of the dynamic rotor 40, which is located within the premixing chamber 60. The hexagonal bore 41 matches the driving hexagonal shaft of the dispenser (not shown). Because of the special arrangement of the depth of the opening 31 on the cover 30 (refer to FIG. 2), matching the type A dispenser, the posts 43 of the type A dynamic rotor 40 are located only on the downstream side of the wings 42. Note that the wings 42 are molded out from the rotor stem perpendicular to its axis. The posts are molded out from the wings and oriented parallel to the axis of the rotor. Both wings and posts are necessary to achieve effective mixing of the components.

Figure 4:
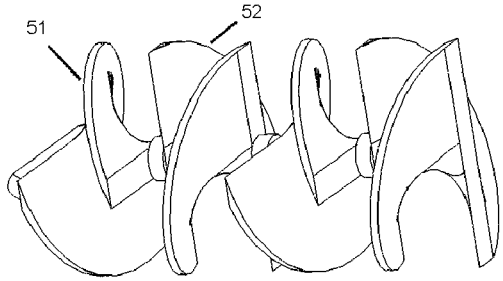
FIG. 4 is a perspective view of the static element, where.

FIG. 4 shows the structure of the static shaft 50 in detail. The static shaft comprises several sets of twisted elements extending radially within the tubular part of the housing. Each blade pair (51 or 52) is like a flat sheet twisted through 180 degrees around its central axis and the trailing edge of each downstream blade is perpendicular to the leading edge of the following upstream blade. Or, in other words, alternating blades are twisted in opposite directions. All the serially-arranged blades are axially molded as a whole unit. When the flow from the premixing chamber 60 is pressed forward to the tubular mixing chamber 70 where the static shaft 50 is located, the static shaft is prevented from continuously rotating by the stopping structure of the housing (refer to FIG. 5), so that the flow is forced to rotate clockwise and anti-clockwise alternately by the alternately twisted blade surfaces. This results in an excellent mixing effect with any air bubbles trapped from the premixing chamber being easily expelled.

FIG. 5 reveals the connection between the dynamic rotor 40, the static shaft 50, the stopping structure on the housing. The dynamic rotor 40 and the static shaft 50 are aligned axially but loosely locate each other inside the housing 20. The dome-shaped end 45 will create only a small amount of friction between the rotating rotor and the upstream end 53 of the static element because they contact each other only at a small central area. The downstream end 54 of the static element is prevented from rotating more than 180 degrees because of the two splinters 22 on the inner wall of the housing 20.

Although the present invention has been described in terms of the presently preferred embodiment, it is to be understood that such disclosure is not to be interpreted as exhaustive or limiting. Various alterations and modifications will no doubt become apparent to those skilled in the fabrication of such devices after reading the above disclosure. Accordingly, it is intended that the appended claims be interpreted as covering all alterations and modifications as fall within the true spirit and scope of the invention.

I claim:

1. A device for mixing two paste components comprising:

a substantially tubular housing with an outlet opening at the downstream end and a cover with two inlet openings at the upstream end arranged to match a paste dispenser;

a dynamic rotor which consists of a rotor shaft and several wings perpendicular to said rotor shaft and several posts on said wings;

a static shaft which consists of a cylindrical shaft body and a series of alternately-twisted blades.

2. The mixing device of claim 1, wherein:

said housing is divided into a premixing chamber adjoining the inlet cover and a tubular mixing chamber adjoining the outlet opening.

3. The mixing device of claim 1, wherein:

said dynamic rotor, which consists of said shaft, wings, and posts, is located inside said premixing chamber, transferring the rotational motion from said paste dispenser to said premixing chamber.

4. The mixing device of claim 3, wherein:

the upstream end of said dynamic rotor is connected to the driving element of the paste dispenser to accept driving torque.

5. The mixing device of claim 3, wherein:

said wings and posts on said dynamic rotor premix the paste components as a result of the rotational motion of said rotor shaft.

6. The mixing device of claim 3, wherein:

the downstream end of said dynamic rotor is dome-shaped so that said loose contact to the upstream end of said static shaft reduces the rotational friction to the least possible amount.

7. The mixing device of claim 1, wherein:

said static shaft, which consists of a cylindrical shaft body and a series of alternately-twisted blades, is located inside said tubular mixing chamber, contacting the downstream end of said dynamic rotor.

8. The mixing device of claim 7, wherein:

said static shaft is next to the downstream end of said dynamic rotor, making loose contact such that said static shaft will not be strongly driven rotationally by said dynamic rotor.

9. The mixing device of claim 7, wherein:

said series of alternately-twisted blades of said static shaft substantially remain stationary relative to said housing when the paste components flow through, forcing the components to flow in opposite rotational directions from one blade to the next, resulting in a thorough mixing.

10. The mixing device of claim 1, wherein:

a pair of splinters on the inner wall of the downstream end of the tubular portion of said housing prevents said static shaft from being rotated more than 180 degrees by the paste components flowing through said tubular mixing chamber, so that said static shaft quickly becomes stationary relative to said housing when the paste components flow through.

* * * * *